US005351615A

United States Patent [19]

Köbler et al.

[11] Patent Number: 5,351,615

[45] Date of Patent: Oct. 4, 1994

[54] OFFSET BLANKET FOR A GROOVELESS BLANKET CYLINDER COMPOSED OF A CARRIER PLATE AND A RUBBER LAYER PLACED THEREON

[75] Inventors: Ingo Köbler, Anhausen; Hans Mamberer, Königsbrunn; Eduard Hoffmann, Bobingen; Wolfgang Prem, Ustersbach, all of Fed. Rep. of Germany

[73] Assignee: MAN Roland Druckmaschinen AG, Offenbach, Fed. Rep. of Germany

[21] Appl. No.: 66,769

[22] Filed: May 25, 1993

[30] Foreign Application Priority Data

May 29, 1992 [DE] Fed. Rep. of Germany ..... 4217793

[51] Int. Cl.[5] ..... B41F 30/04; B41F 13/08

[52] U.S. Cl. ..... 101/217; 101/376; 101/401.1; 101/DIG. 36; 492/54; 492/56; 29/895.21; 29/895.23; 219/121.64

[58] Field of Search ..... 101/216, 217, 141, 142, 101/375, 376, 378, 382.1, 383, 389.1, 395, 401.1, 415.1, 492, 493, DIG. 36; 492/54, 56; 29/895.21, 895.23; 219/121.63, 121.64

[56] References Cited

U.S. PATENT DOCUMENTS

| | | | |
|---|---|---|---|
| 3,196,701 | 7/1965 | Morrow | 492/48 |
| 3,717,234 | 2/1973 | Koller | 101/377 |
| 3,765,329 | 10/1973 | Kirkpatrick et al. | 101/415.1 |
| 3,883,940 | 5/1975 | Wagner | 101/415.1 |
| 3,982,312 | 9/1976 | Finzer | 492/48 |
| 4,286,031 | 8/1981 | Kuehnle et al. | 101/131 |
| 4,378,737 | 4/1983 | Kirkpatrick | 101/415.1 |
| 4,680,067 | 7/1987 | Moore | 101/378 |
| 4,913,048 | 4/1990 | Tittgemeyer | 101/141 |
| 5,125,337 | 6/1992 | Zeller | 101/415.1 |
| 5,168,808 | 12/1992 | Prem | 101/375 |
| 5,178,068 | 1/1993 | Junghans et al. | 101/415.1 |

FOREIGN PATENT DOCUMENTS

| | | | |
|---|---|---|---|
| 2700118C2 | 4/1977 | Fed. Rep. of Germany . | |
| 7802683U1 | 1/1978 | Fed. Rep. of Germany . | |
| 32154 | 3/1979 | Japan | 219/121.64 |
| 18591 | 1/1989 | Japan | 219/121.64 |

*Primary Examiner*—Edgar S. Burr
*Assistant Examiner*—Stephen R. Funk
*Attorney, Agent, or Firm*—Cohen, Pontani, Lieberman, Pavane

[57] ABSTRACT

An offset blanket for a grooveless blanket cylinder for applying a printed image onto web material or sheet material is composed of a carrier plate which has been cut to size and a rubber layer placed on the carrier plate. The beginning and the end of the carrier plate of the rubber layer are connected to each other so that the outer circumferential surface of the blanket is continuous and without gaps. The blanket surrounds the blanket cylinder in the operating position in the form of a sleeve in a frictionally engaging manner but releasably. A register device is provided on at least one end face of the blanket for securely positioning the blanket on the blanket cylinder.

20 Claims, 3 Drawing Sheets

OFFSET BLANKET FOR A GROOVELESS BLANKET CYLINDER COMPOSED OF A CARRIER PLATE AND A RUBBER LAYER PLACED THEREON

BACKGROUND OF THE INVENTION

1. Field of the Invention

The present invention relates to an offset rubber blanket for a grooveless or, ductless blanket cylinder for applying a printing image on sheet material or web material.

2. Description of the Related Art

Blankets which are used in offset printing as pressure blankets are usually composed of several different types of materials as well as various fabric components in order to increase the strength thereof. Natural rubber and synthetic rubber are used as blanket materials. A compressible rubber blanket additionally requires hard support surfaces which are not displaceable, or the blanket can be mounted on a blanket cylinder. Such a blanket cylinder has an axially extending groove or duct with clamping segments in which the opposite ends of the blanket are fastened. A blanket of excellent quality, correctly cut to size and well aligned, forms the basis of good offset printing. The printing image is applied on the blanket by means of a plate cylinder. However, it is not possible to produce endless images because of the blanket discontinuity resulting from the cylinder groove and the contact interruption between the cylinders which roll off on each other.

Moreover, vibrations result from the asymmetrical construction of the cylinders which roll off on each other and as a result of impacts at the groove. In addition, at high machine speeds, impact forces result from mass times acceleration which excite the natural or inherent bending forces of the cylinder, so that the printing quality is impaired. In addition, the loads due to vibration limit the printing widths if a certain weight of the revolving body is not to be exceeded.

For example, German Patent 27 00 118 C2 discloses a type of blanket in which an endless or continuous coating is applied on an exchangeable carrier sleeve of plastics material or a metal material. The coating is of an elastic material, preferably rubber. The rubber layer forms a tube which is completely free of gaps and seams and is tightly placed on the hollow body and its properties are identical to those of the above-described conventional blanket. The blanket sleeve manufactured in this manner is then mounted, for example, in accordance with the method described in German Patent 27 00 118 C2 or as known from flexo-printing, by sliding the blanket sleeve by means of compressed air over a printing cylinder core, i.e., the blanket cylinder, and subsequently fixing the blanket sleeve by switching off the supply of compressed air. However, the manufacture of such a blanket sleeve is very expensive. This is because the nickel and glass fiber-reinforced plastics material preferably used for the hollow body in order to achieve the necessary quality are comparatively expensive. In addition, compared to the manufacture of conventional blankets which can be continuously cut to size and processed in the plane state, the manufacture of the above-described blanket sleeve is very cumbersome because, the treating the circumference of a sleeve, each treatment step must be carried out individually, and in particular the rubber coating must be applied while the sleeve rotates.

SUMMARY OF THE INVENTION

Therefore, it is a primary object of the present invention to provide an offset blanket which can be manufactured inexpensively and in a simple manner. In addition, printing quality losses due to vibration loads as a result of impacts at the groove are to be prevented in the blanket, so that the occurrence of mackled sheets is reduced.

In accordance with the present invention, the blanket is composed of a carrier plate which is cut to size and a rubber layer applied on the carrier plate. Beginning and end of the carrier plate and of the rubber layer are connected to each other in such a way that the outer circumferential surface of the blanket is continuous and without gaps, so that, in the position of operation of the blanket, the blanket surrounds the blanket cylinder in the form of a sleeve in a frictionally engaging but releasable manner. In addition, means for reproducibly positioning the seam connecting the beginning and the end of the blanket are provided.

The present invention also proposes a method of manufacturing a blanket in the form of a sleeve with a continuous, gap-free surface. An offset blanket manufactured in this manner can be used on a grooveless blanket cylinder, as it is known, for example, from German Patent 27 00 118 C2. For expanding the sleeve-shaped blanket, the blanket cylinder is connected to a pressurized gas supply line which exits on the surface of the blanket cylinder. Accordingly, the blanket can be slid onto the outer circumferential surface of the blanket cylinder with the aid of pressurized gas. Thus, while the blanket is placed on the blanket cylinder in the position of operation so as to be secured against displacement, the blanket can still be easily removed from the blanket cylinder without being destroyed and, as a result, the blanket is reusable.

The outer surface of the blanket and the ink-transferring surface of the printing form of the plate cylinder are in rolling contact. A printing form in accordance with German Patent application P 41 40 768.7 is preferably used for this purpose. Since the outer circumferential surface of the blanket is continuous and without gaps, a rolling contact which is without impacts and vibrations can be achieved between the blanket and the ink-transferring surface of the printing form of the plate cylinder.

The blanket according to the present invention does not require a very massive blanket cylinder, such as, a solid blanket cylinder with clamping groove. Comparatively light blanket cylinders can be quickly accelerated to high rates of rotation without the occurrence of vibration loads resulting from impacts due to the groove, so that the blanket cylinder may have a large width.

The use of conventional blanket clamping devices, groove segments and clamping segments is no longer required and, therefore, the costs for these elements can be saved. It is only necessary to provide means for reproducibly positioning the seam connecting the beginning and the end of the blanket on the cylinder circumference. Of course, the seam of the blanket must be positioned on the blanket cylinder in such a way that the seam of the blanket and the seam of the printing form always roll off on each other in order to obtain a printing length which is utilized in an optimum manner.

Conventional devices can be used for this purpose. For example, the thin blanket sleeve can be mounted in such a way that markings on the cylinder surface coincide with markings on the blanket sleeve. Advantageously, the blanket cylinder is provided with pins which can be engaged by recesses of the blanket in order to position the blanket correctly on the cylinder.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DESCRIPTION OF THE PRESENTLY PREFERRED EMBODIMENTS

Figure 1:
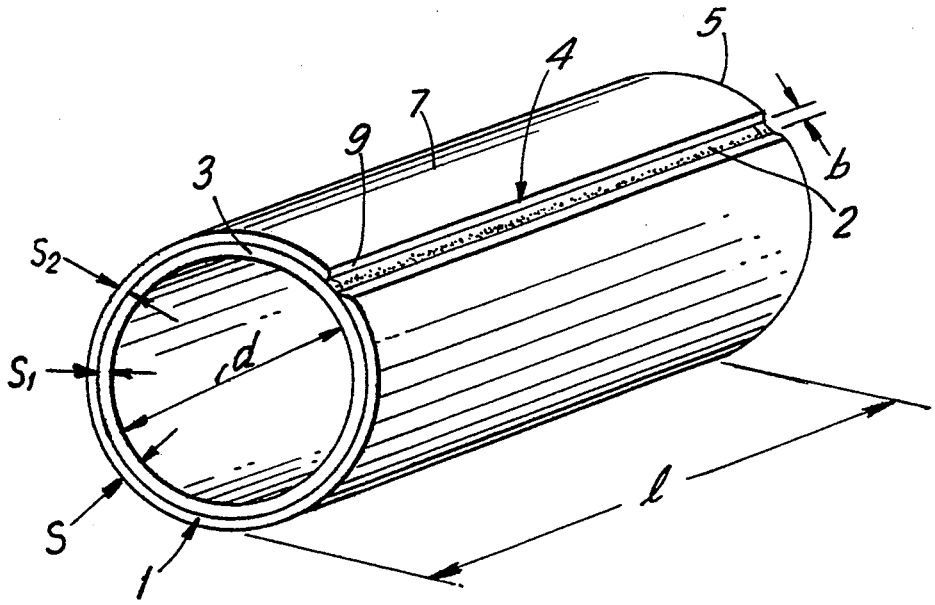
FIG. 1 is a perspective front view of a sleeve-shaped offset blanket with a welding seam.

FIG. 1 of the drawing shows a carrier plate 1 in the form of a thin sheet having a thickness $S_1$ of preferably 0.15 mm shaped into a sleeve having a diameter d of about 300 mm and a width 1 of about 1600 mm. The carrier plate is of a metal material, preferably steel, particularly stainless steel, or aluminum. The carrier plate 1 may also be of plastics material, preferably fiber-reinforced resin, for example, glass fiber-reinforced polyester resin or glass fiber-reinforced epoxy resin.

A rubber layer 7 having a thickness $S_2$ of about 2 mm is placed or vulcanized on the carrier plate 1. The properties of the rubber layer 7 are the same as those of the rubber layer of a conventional blanket. The thickness S of the blanket is equivalent to the sum of $S_1$ plus $S_2$. The beginning and end of the carrier plate 1 are longitudinally welded together. The welding seam 2 preferably has a width b of about 0.7 mm. A recess 4 exists between the beginning and the end of the rubber layer 7. The width of the recess 4 of the rubber layer 7 is less than 1 mm.

Figure 2:
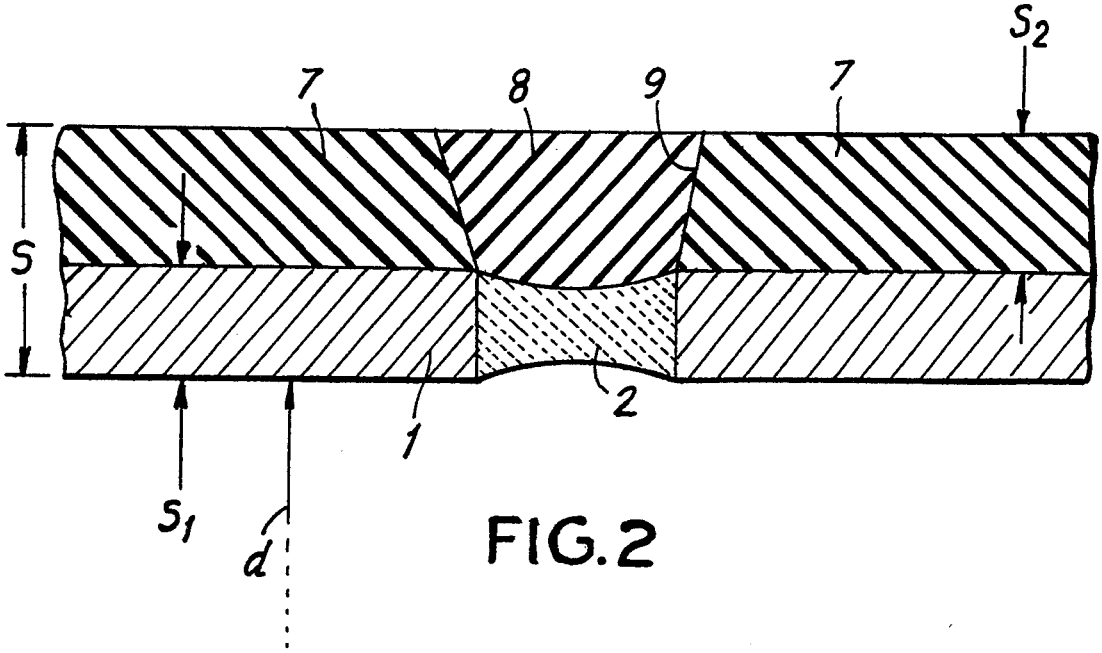
FIG. 2 is a cross sectional view, on a larger scale, of the blanket of FIG. 1 with an evened rubber layer.

As illustrated in FIG. 2, the welding seam 2 of the carrier plate 1 has a concave shape at the top and bottom sides thereof. Both sides 9 of the recess 4 of the rubber layer 7 are inclined, so that access to the carrier plate 1 is facilitated during the welding procedure. As shown in FIG. 2, the recess 4 of the rubber layer 1 is bridged by means of a filler 8. The material of the filler 8 is preferably also rubber, so that its properties are at least similar to those of the rubber layer 7.

Figure 3:
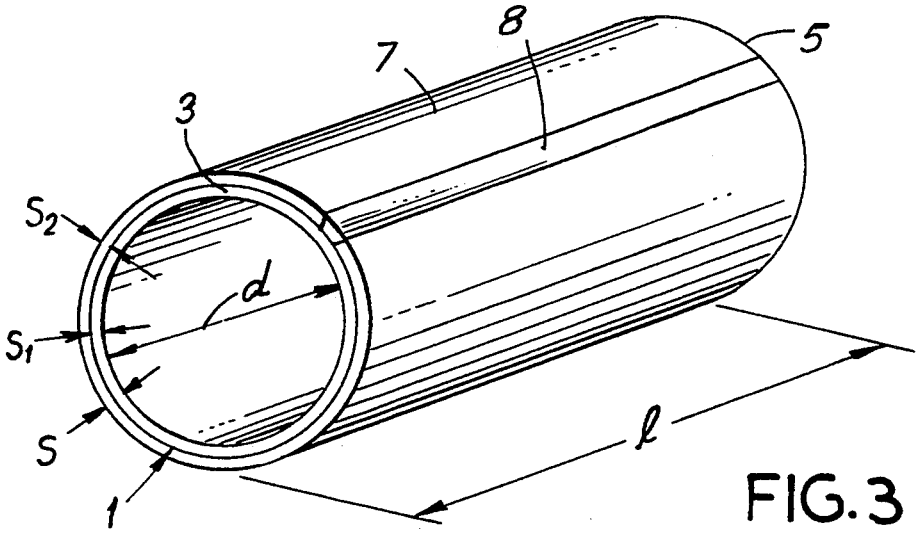
FIG. 3 is perspective front view of a sleeve-shaped offset blanket with gap-free rubber layer.

Accordingly, the rubber layer 7 of the blanket has a continuous, gap-free outer surface, as illustrated in FIG. 3.

Figure 4:
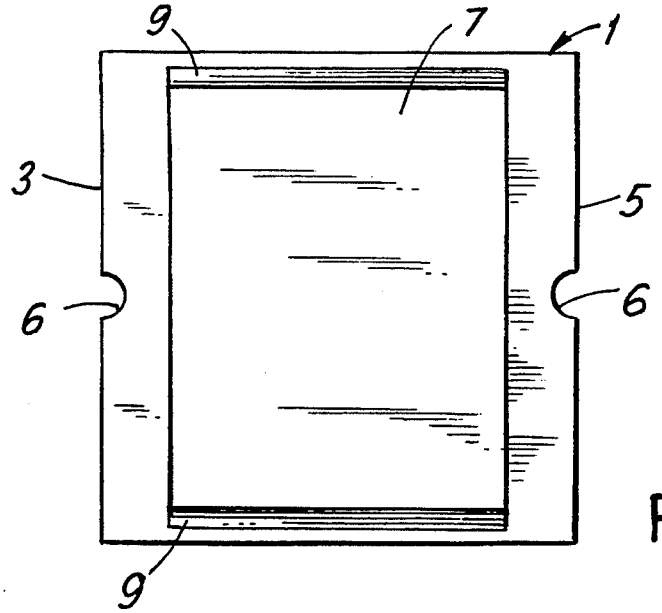
FIG. 4 is a plan view of a plane blanket with a register device.

FIG. 4 of the drawing shows a plane carrier plate 1 which has already been provided with a rubber layer 7. Recesses 6 are punched out at both end faces 3 and 5 of the carrier plate 1. The recesses 6 interact in the known manner with pins provided on the surface of the blanket cylinder.

The method of manufacturing the blanket according to the present invention includes the following steps. The rubber layer 7 is vulcanized in the known manner onto a web-like sheet metal which is in the plane state after having been pulled previously, for example, from a coil. The sheet metal forms a carrier plate 1. The carrier plate 1 together with the rubber layer 7 placed thereon are cut to a size corresponding to the circumference and width of the blanket cylinder. As is the case in the manufacture of a conventional blanket, the cutting procedure is carried out on a cutting machine exactly at the correct angle and size. At least one of the end faces 3 or 5 is provided with a recess 6 by means of a plate punching device. The carrier plate 1 is mounted in a welding device in the correct position by means of the recesses 6. The carrier plate 1 is then shaped into a sleeve and the beginning and end of the carrier plate 1 are longitudinally welded. The welding operation may be guided linearly, in a S shape, a rectangular shape or other suitable geometric shapes. The welding process is carried out by means of a known welding procedure, but preferably by means of a Neodymium-YAG-Laser. The control of the laser power and the possibility of operating the laser in a continuous or pulsed manner, make it possible to provide a controlled and exactly reproducible energy influence on the material being welded. Compared to other thermal methods, the heat application and distortion of the welded material are extremely small. The welding process is carried out in such a way that a welding seam 2 is produced which has a concave shape at the top and bottom sides thereof.

The sleeve-shaped blanket produced in the above-described manner is slid onto the blanket cylinder exclusively by expanding the blanket by means of compressed air. When the application of compressed air is stopped, the blanket is mounted with frictional engagement on the blanket cylinder.

Therefore, the gist of the present invention resides in providing a carrier plate of an inexpensive plastics material or a metal material onto which a rubber layer has been vulcanized, shaping the carrier plate into a sleeve-like blanket for the purpose of grooveless printing, wherein the blanket in its position of operation surrounds the blanket cylinder in a frictionally engaging manner but releasably and reusably, and wherein the blanket has a continuous, gap-free outer surface.

Figure 5:
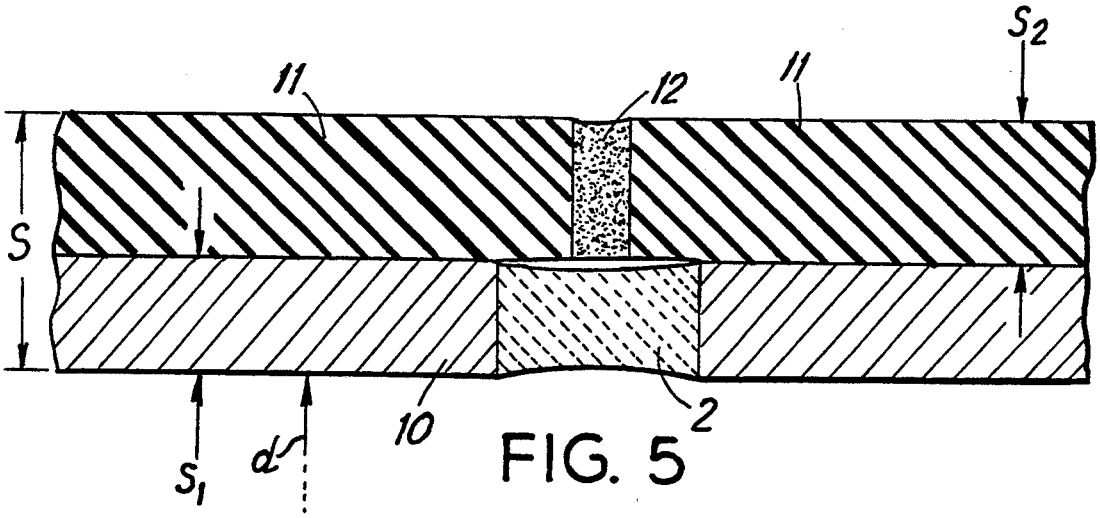
FIG. 5 is a cross sectional view of a blanket similar to FIG. 2 with a welded longitudinal seam of the rubber layer of the blanket.

In the embodiment illustrated in FIGS. 1–4, it is possible during the cutting procedure to prepare inclined edge zones at the beginning and end of the carrier plate 1, or to cut the rubber layer 7 in such a way that the rubber layer 7 has inclined sides 9 at the edge zones at the beginning and end of the carrier plate 1, so that the welding procedure of the carrier plate 1 can be carried out from the rubber-coated side and the recess 4 between the beginning and end of the rubber layer 7 is then bridged by means of a filler 8. However, it is also possible to provide a carrier plate 10 without edge zones and a rubber layer 11 without inclined sides 9, so that the beginning and end of the carrier plate 10 are longitudinally welded together from the uncoated side and the beginning of the rubber layer 11 is then also longitudinally welded to the end of the rubber layer 11, wherein the welding seam 12 of the rubber layer 11 has at the top side thereof a concave shape, as can be seen in FIG. 5. Bridging by means of a filler 8 is not necessary in this case.

Figure 6:
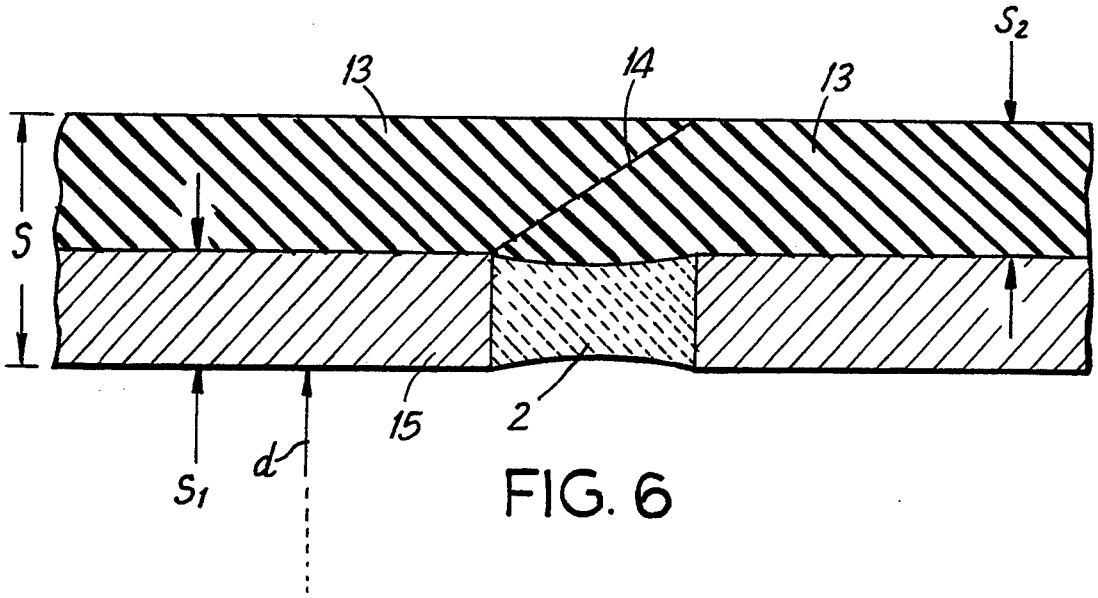
FIG. 6 is a cross sectional view of a blanket similar to FIG. 2 with a glued longitudinal seam of the rubber layer of the blanket.

However, it is also possible, as illustrated in FIG. 6, to glue the longitudinal seam 14 of the joint between beginning and end of a rubber layer 13 onto a longitudinally welded seam of a carrier plate 15, wherein the longitudinal seam 14 of the joint is located outside of the concave portion of the welding seam 2.

Figure 7:
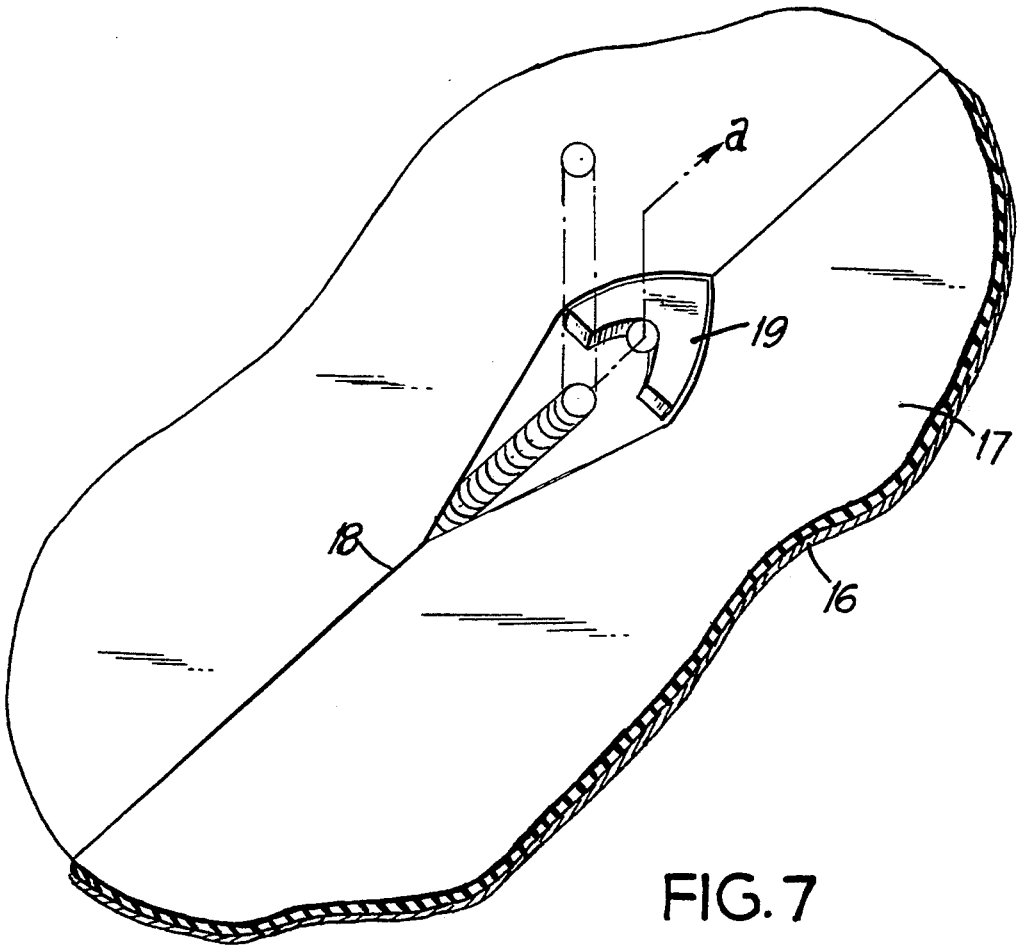
FIG. 7 is a perspective top view showing a procedure for welding together the beginning and end of a carrier plate from the rubber-coated side of the blanket.

FIG. 7 of the drawing shows another possibility of a procedure for connecting the beginning and end of a carrier plate 16 and of a rubber layer 17 in such a way that the outer circumferential surface of the blanket is continuous and gap-free, wherein the welding process of the carrier plate 16 can be carried out from the rubber-coated side, without providing edge zones at the beginning and end of the carrier plate 16 and without inclined sides of the rubber layer 17 at these locations.

As shown in FIG. 7, a wedge-shaped element 19 is guided along the longitudinal seam 18 of the joint between beginning and end of the rubber layer 17, wherein the element 19 opens the longitudinal seam 18 at most by approximately 0.7 mm and the longitudinal seam 18 closes by itself behind the element 19 as seen in the direction of movement a of the element 19. During the movement of the wedge-shaped element 19, a laser is guided following the element 19 in such a way that the laser can weld the carrier plate 16 from the coated side along the longitudinal seam 18. As already described above, the longitudinal seam 18 of the rubber layer 17 is also welded or glued.

It is also conceivable to connect the beginning and end of the carrier plate and the beginning and end of the rubber layer by gluing. For example, the beginning of the carrier plate is glued onto half of a longitudinally extending saddle, the end of the carrier plate is glued onto the other half of the longitudinally extending saddle and the joints of the beginning and end of the carrier plate and of the rubber layer are additionally glued together. Subsequently, the sleeve-shaped blanket is slid together with the saddle onto the blanket cylinder as described above.

It should be understood that the preferred embodiment and examples described are for illustrative purposes only and are not to be construed as limiting the scope of the present invention which is properly delineated only in the appended claims.

We claim:

1. An offset blanket for a grooveless blanket cylinder for applying a printed image on sheet material or web material, the blanket comprising: a carrier plate which is cut to size; a rubber layer having a width corresponding to a printing width being placed on the carrier plate, the carrier plate and the rubber layer each having a beginning and an end, the blanket having an outer circumferential surface; means for bonding the beginning and end of the carrier plate and the beginning and end of the rubber layer to each other such that the outer circumferential surface of the blanket is continuous and gap-free and the blanket forms a sleeve-shape, the sleeve-shaped blanket having end faces and being adapted to be removably mountable on the blanket cylinder in a frictionally engaging manner; and means for positioning the blanket on the blanket cylinder, the positioning means being provided on at least one of the end faces of the blanket.

2. The offset blanket according to claim 1, wherein the bonding means includes a welding seam bonding the beginning and end of the carrier plate, a recess being defined between the beginning and the end of the rubber layer, and a filler of rubber being placed in the recess.

3. The offset blanket according to claim 1, wherein the bonding means includes a welding seam bonding the beginning and the end of the carrier plate, and a welding seam bonding the beginning and the end of the rubber layer, wherein the rubber layer extends over the entire length of the carrier plate.

4. The offset blanket according to claim 1, wherein the bonding means includes a welding seam bonding the beginning and the end of the carrier plate, and a glued connection bonding the beginning and the end of the rubber layer, wherein the rubber layer extends over the entire length of the carrier plate.

5. The offset blanket according to claim 1, wherein the bonding means including a glued connection between the beginning and the end of the carrier plate and a glued connection between the beginning and the end of the rubber layer, wherein the rubber layer extends over the entire length of the carrier plate.

6. The offset blanket according to claim 1, wherein the carrier plate is of aluminum.

7. The offset blanket according to claim 1, wherein the carrier plate is of steel.

8. The offset blanket according to claim 1, wherein the carrier plate is of plastics material.

9. The offset blanket according to claim 1, wherein the positioning means at the end faces has recesses adapted to be engaged by pins mounted on the blanket cylinder.

10. A method of manufacturing an offset blanket mounted on a grooveless blanket cylinder for applying a printed image on sheet material or web material, the method comprising applying a rubber layer on a plane web-like sheet metal; cutting the sheet metal including the rubber layer to a size corresponding to a circumference and a width of the blanket cylinder, wherein the cut sheet metal forms a carrier plate; providing on at least one end face of the carrier plate a means for positioning the blanket on the blanket cylinder; connecting beginning and end of the carrier plate and connecting beginning and end of the rubber layer such that a sleeve-shaped blanket with a grooveless rubber layer is formed, wherein the beginning and the end of the carrier plate are connected by means of a longitudinal welding seam having a concave shape at an upper side and a lower side thereof; expanding the sleeve-shaped blanket by applying compressed air against the blanket and sliding the blanket onto the blanket cylinder; and securing the blanket on the blanket cylinder by switching off the compressed air.

11. The method according to claim 10, wherein the web-like sheet metal is pulled off a coil prior to applying the rubber layer.

12. The method according to claim 10, wherein cutting the carrier plate produces edge zones at the beginning and the end of the carrier plate, further comprising producing the longitudinal seam at the edge zones of the carrier plate from the side of the carrier plate covered with the rubber layer; and connecting the beginning and the end of the rubber layer by placing a filler of rubber material in a recess defined between the beginning and the end of the rubber layer.

13. The method according to claim 10, comprising applying the rubber layer along the entire length of the carrier plate; producing the longitudinal welding seam of the carrier plate from a side of the carrier plate opposite the rubber layer; and connecting the beginning and the end of the rubber layer by means of a welding seam having a concave shape at an upper side thereof.

14. The method according to claim 10, comprising applying the rubber layer along the entire length of the carrier plate; producing the longitudinal welding seam for connecting the beginning and the end of the carrier plate from a side of the carrier plate opposite the rubber layer; and gluing the beginning and the end of the rubber layer together.

15. The method according to claim 10, wherein the beginning and the end of the rubber layer form a joint, comprising guiding a wedge-shaped element along the joint such that the joint is opened by the wedge-shaped element and closes again behind the wedge-shaped element; guiding a laser welding beam following the wedge-shaped element, so that the laser welding beam produces the longitudinal welding seam of the carrier plate from the side of the carrier plate which is coated with the rubber layer.

16. The method according to claim 15, wherein the beginning and the end of the rubber layer are welded together.

17. The method according to claim 15, wherein the beginning and the end of the rubber layer are glued together.

18. The method according to claim 15, comprising using a Neodymium-YAG-Laser for producing the welding seam.

19. The method according to claim 15, wherein the web-like sheet metal is pulled off a coil prior to applying the rubber layer.

20. The method according to claim 10, comprising vulcanizing the rubber layer onto the carrier plate.

* * * * *